US007486925B2

(12) United States Patent
Breen

(10) Patent No.: US 7,486,925 B2
(45) **Date of Patent: *Feb. 3, 2009**

(54) METHOD AND APPARATUS FOR MONITORING AUDIO LISTENING

(76) Inventor: Julian H. Breen, Six Queens La., Pennington, NJ (US) 08534-2910

( * ) Notice: Subject to any disclaimer, the term of this patent is extended or adjusted under 35 U.S.C. 154(b) by 0 days.

This patent is subject to a terminal disclaimer.

(21) Appl. No.: 11/657,807

(22) Filed: Jan. 25, 2007

(65) Prior Publication Data

US 2007/0124757 A1 May 31, 2007

Related U.S. Application Data

(63) Continuation of application No. 10/383,421, filed on Mar. 6, 2003, now Pat. No. 7,181,159.

(51) Int. Cl.
*H04H 9/00* (2006.01)

(52) U.S. Cl. ..... 455/2.01; 455/3.01; 455/67.11; 455/419

(58) Field of Classification Search ..... 455/2.01, 455/3.01, 405, 456.1, 428, 422.1, 509, 517, 455/419, 420, 67.11, 418, 3.02–4, 414.1–2, 455/69, 404.2, 3.02, 3.03, 3.04, 414.4; 725/18, 725/9, 10

See application file for complete search history.

(56) References Cited

U.S. PATENT DOCUMENTS 5,382,970 A * 1/1995 Kiefl ..... 455/2.01
5,450,490 A 9/1995 Jensen et al.
5,579,124 A 11/1996 Aijala et al.
5,787,334 A * 7/1998 Fardeau et al. ..... 725/22
5,896,554 A * 4/1999 Itoh ..... 455/2.01
6,683,958 B2 * 1/2004 Petrovic ..... 713/176
6,934,508 B2 * 8/2005 Ceresoli et al. ..... 455/2.01
7,316,025 B1 * 1/2008 Aijala et al. ..... 725/18
2003/0101451 A1 * 5/2003 Bentolila et al. ..... 725/34
2005/0096920 A1 * 5/2005 Matz et al. ..... 705/1

* cited by examiner

*Primary Examiner*—John J Lee
(74) *Attorney, Agent, or Firm*—Milde & Hoffberg, LLP

(57) ABSTRACT

A method and apparatus receive, detect, collect and analyze program-identifying ("PI") information contained in a plurality of broadcast or recorded electronic audio signals. Each audio signal represents the sounds (audio portion) in a plurality of sequential program segments, such as program material or commercials. The method comprises the steps of receiving a selected one of the audio signals at each of a plurality of remote locations; reproducing the sounds represented by the selected audio signal at each remote location; converting the sounds into a second electronic signal at each remote location; detecting the PI information from the second signal at each remote location; storing the detected PI information at each remote location; establishing a wireless communication link between each remote location and a central computer at another location and transmitting the PI information to the central computer; storing the PI information received from the plurality of remote locations at the aforesaid central computer; and analyzing the stored PI information to obtain a statistical estimate of the relative number of persons who listened to the sounds in each given program segment.

43 Claims, 3 Drawing Sheets

METHOD AND APPARATUS FOR MONITORING AUDIO LISTENING

CROSS-REFERENCE TO RELATED APPLICATION

This application is a continuation of U.S. patent application Ser. No. 10/383,421, filed Mar. 6, 2003, and entitled "METHOD AND APPARATUS FOR MONITORING AUDIO LISTENING", now U.S. Pat. No. 7,181,159, whose contents are incorporated by reference.

BACKGROUND OF THE INVENTION

The present invention relates to a method and apparatus for monitoring and measuring audience exposure to radio programming, television programming, audio and video recordings and the like. Since its origins in the mid-1960's the basic data collection instrument for radio audience estimates of The Arbitron Company of Columbia, Md. ("Arbitron") has been a one week diary which Arbitron "respondents" were asked to fill out. The diaries were then mailed to Arbitron's central processing facility in Columbia, Md., photographed and keypunched. The radio audience measurement data was then calculated from the information contained in the diaries.

Human nature being what it is, the diary methodology was less a moment-by-moment account of radio exposure and more a means of recording recollected exposure. Studies have shown that most diaries were routinely filled out only daily or at the end of the diary week rather than at the time of radio listening. While this may be a significant disadvantage, compared to other available methodologies, such as telephone canvassing and recall, the diary proved to deliver reasonably stable and believable audience estimates.

As a consequence, Arbitron became, and remains, a dominant radio audience measurement firm in the United States and is the only supplier of radio audience estimates in the larger radio markets. Every year billions of advertising dollars flow into U.S. radio stations and networks based on Arbitron audience estimates.

Various attempts have been made to simplify the process and system of monitoring audience exposure to radio and television programming. In one such system, disclosed in the U.S. Pat. No. 5,382,970, a "portable data meter" is provided for each radio listener or television viewer which records the identity of a radio station or TV channel that is being currently listened to or watched. This station or channel data is stored in association with the current date and time and later transmitted to a central computer via a built-in cellular telephone. The subject matter of this patent is incorporated herein by reference.

One drawback of this patented system is inherent in the information that is stored and forwarded. For TV monitoring the system receives the channel selection by intercepting the infra-red transmissions of a TV remote control. For radio monitoring the user must press a station selection button on the data meter in addition to changing the station on the radio dial. This is not only inconvenient, but this system can result in inaccuracies if the person carrying the data meter does not point the TV remote at it whenever a TV channel is selected, or does not press the station selection button when selecting a radio station.

To ensure that each person monitored is actually in the same room as, and actually hears, the television or radio programming which is allegedly being watched or listened to, the portable data meter is provided with means to issue a "warning" when certain inaudible sounds produced by a television or radio loudspeaker are not received by a built-in microphone. To facilitate this operation, the broadcast signal from the various broadcast stations that may be selected have an additional signal imposed on their sound carrier outside the normal audio range. Each portable data meter is provided with a sound detector for this additional signal and a warning device such as a beeper. The processor within the data meter is made responsive to the receipt of the additional signal to activate the warning device and then to commence the recording of data only if and when the owner of the data meter presses a button or the like to signal his/her presence.

In the early 1990's Arbitron began to develop what has become known as the "Portable People Meter", also known as "Personal People Meter" or "PPM". The structure and operation of the PPM are disclosed in the U.S. Pat. Nos. 5,579,124 and 5,450,490, both assigned to Arbitron. The subject matter of these two patents is also incorporated herein by reference.

The Arbitron PPM system operates generally as follows:

1. Broadcasters, cable operators and record companies encode their audio streams using an Arbitron supplied unit which inserts inaudible code information. The codes may identify each program segment (e.g. song, commercial, radio show or the like) as it is transmitted or played. Alternatively or in addition, the codes may identify the TV channel or radio station that is broadcasting, without further identifying the particular program material or segment that is being broadcast. Any and all program identifying information, which is identified by the codes received and decoded, such as by a Personal People Meter, are denoted hereinafter as "program-identifying" ("PI") information. The inaudible (or audible) code information which identifies program material segments (songs, commercials, radio shows) is denoted hereinafter as "program material-identifying" ("PMI") information.
2. Respondents (persons used in the audience measurement) carry the pager-sized Personal People Meter which contains a motion sensor, a clock and a means, including a microphone, for receiving, detecting and recording the codes when the wearer is exposed to an encoded audio stream. The clock is used to determine and record the date, time and duration of exposure.
3. At the end of each day respondents place the PPM into a cradle which is plugged into the respondent's home electrical system. The cradle recharges the meter's battery and extracts the recorded exposure data, sending it to a household hub which is attached to both the home electrical supply and the home telephone wire line.
4. At some time during the night, the household hub is interrogated via telephone by a central computer and the stored data is downloaded.

While the Personal People Meter is an extremely useful and convenient device for gathering data regarding audience exposure to electronic media, it has a number of drawbacks.

1. There is no inherent benefit to a respondent to reliably carry the PPM. Although Arbitron rewards respondents with small cash awards and points for compliance toward larger prizes, these benefits are indirect and are not a strong incentive to maintain full compliance.
2. The PPM system is an inherently "home based" concept. Although the Meter itself may be carried anywhere, it must be returned to its charging cradle at the end of each day to recharge its batteries and unload its data to the household hub for transmission to Arbitron. This data collection method fails if the respondent does not return home every night.

SUMMARY OF THE INVENTION

These disadvantages noted above are overcome, and certain advantages noted below are achieved, according to the present invention, by combining the PPM device, as developed and disclosed by Arbitron, with a cellular telephone transmitter/receiver.

More particularly, the present invention provides both a method and apparatus for receiving, detecting, collecting and analyzing program-identifying ("PI") information, preferably including program material-identifying ("PMI") information, contained in a plurality of broadcast or recorded electronic audio signals, wherein each audio signal represents the sounds (audio portion) in a plurality of sequential program segments, such as program material or commercials. According to the invention, the method comprises the steps of:

(a) receiving a selected one of the audio signals at each of a plurality of remote locations;

(b) reproducing the sounds represented by the selected audio signal at each remote location;

(c) converting the sounds into a second electronic signal at each remote location;

(d) detecting the PI information from the second signal at each remote location;

(e) storing the detected PI information at each remote location;

(f) establishing a wireless communication link between each remote location and a central computer at another location and transmitting the PI information to the central computer;

(g) storing the PI information received from the plurality of remote locations at the aforesaid central computer; and (h) analyzing the stored PI information, for example to obtain a statistical estimate of the relative number of persons who listened to the sounds in each given program segment.

In a preferred embodiment of the invention, the date and time of receipt of the selected audio signal are stored in association with the PI information contained in the audio signal and the date and time are transmitted to the central computer together with the PI information.

Apparatus according to the present invention, for implementing this method, comprises:

(a) means, such as a microphone, for converting the sounds represented by a selected one of the audio signals into a second electronic signal;

(b) means for detecting the PI information, preferably including the program material-identifying ("PMI") information, from the second signal;

(c) means for storing the detected PI information; and (d) communication means, such as a modem and cellular telephone, for establishing a wireless communication link to a central computer via the public cellular telephone network and for transmitting the PI information, and possibly also the date and time stamp information, to the central computer.

The method and apparatus according to the invention has a number of advantages over the portable data meter disclosed in the U.S. Pat. No. 5,382,970 as well as the Personal People Meter of Arbitron:

1. The system is capable of monitoring the audience of each separate and distinct program and/or commercial, no matter what station or channel broadcasts this program or commercial and no matter when such program or commercial may be broadcast.

2. In the case of the Personal People Meter each respondent may be supplied with a combination PPM-cellular telephone unit, and domestic cellular telephone service, at no cost. The cell phone usage would be the respondent's reward and a powerful inherent incentive to carry the "meter-cell phone" everywhere as well as keeping it charged so that calls could be made and received. No other incentives would be required to ensure respondent compliance.

3. The combination meter-cell phone would enable Arbitron to retrieve the data whenever the respondent was within range of a cell tower. It would not matter if the respondent were home or elsewhere. Therefore, all electronic media exposure could be metered even if the respondent were away on business or for the weekend, on vacation or simply not sleeping at home on a given night of the week. It also simplifies data retrieval for respondents who work late at night or overnight.

4. The location of media exposure can be determined by which cell the combination meter-cell phone was in contact with at any given moment. If the respondent were home, that could be determined by the location of the cell tower serving the respondent's home location. If the respondent were in a vehicle, that could be inferred by the relatively rapid change in cell towers. Accurate inferences could also be developed if the respondent were at work or had traveled on a commercial airline flight.

Alternatively, the location could be determined by a GPS receiver in the combination meter-cell phone.

5. Because of the ability of Arbitron to communicate at any time with the combination meter-cell phone, information and encouragement could be easily communicated to the respondent and software revisions delivered to the device itself.

6. The combination meter-cell phone would eliminate two pieces of custom hardware currently supplied by Arbitron. First, the device would use whatever charger is supplied with the cell phone, so no special meter cradle would be needed. Second, the need for a household hub would be eliminated.

Accordingly, the present invention can provide a material benefit in the Personal People Meter system from both a respondent recruitment and compliance perspective as well as operationally. It makes possible a more accurate measurement of out-of-home electronic media exposure, particularly when the respondent is away from home for longer than one day. It also facilitates the easy delivery of software updates and makes it possible to easily identify the location of the audience exposure information.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
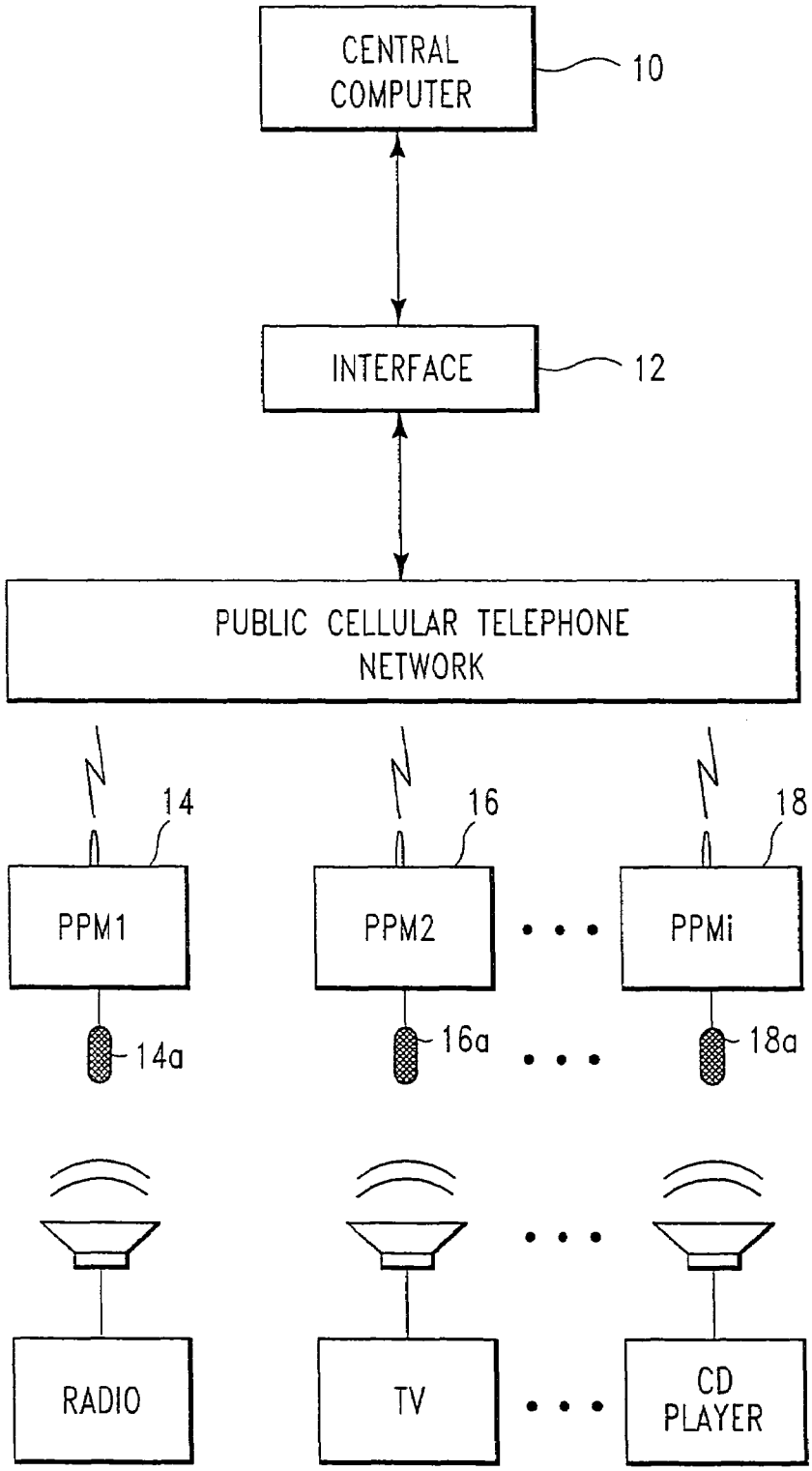
FIG. 1 is a block diagram of the system according to the present invention for receiving, detecting, collecting and analyzing program-identifying information contained in a plurality of broadcast or recorded electronic audio signals.

The preferred embodiments of the present invention will now be described with reference to FIGS. 1-3 of the drawings. Identical elements in the various figures are designated with the same reference numerals.

FIG. 1 illustrates the system according to the present invention which utilizes the Portable People Meter (Personal People Meter or PPM) of Arbitron as disclosed in the aforementioned U.S. Pat. Nos. 5,579,124 and 5,450,490. Details of this system may be found in these patents and will not be repeated here.

The system shown in FIG. 1 comprises a central computer 10 which is connectable to the public telephone network via an interface 12. As such, the central computer 10 and interface 12 may be identical to that presently known from the Personal People Meter system.

Instead of using a wire line telephone network to provide connection to the Personal People Meter units in the field, the communication link is formed by the public wireless telephone network (often called "cellular" or "PCS telephone network in the United States"). This is accomplished simply by providing the cellular telephone numbers of the respective respondents to the interface 12.

In the field, at remote locations, a plurality of respondents are provided with Personal People Meter units 14, 16 and 18 denominated as PPM 1, PPM 2 and PPM i, respectively. These PPM units each have a microphone 14*a*, 16*a* and 18*a*, which receives sound waves, both audible and inaudible, from loudspeakers connected to a radio, television or record player, respectively.

Figure 2:
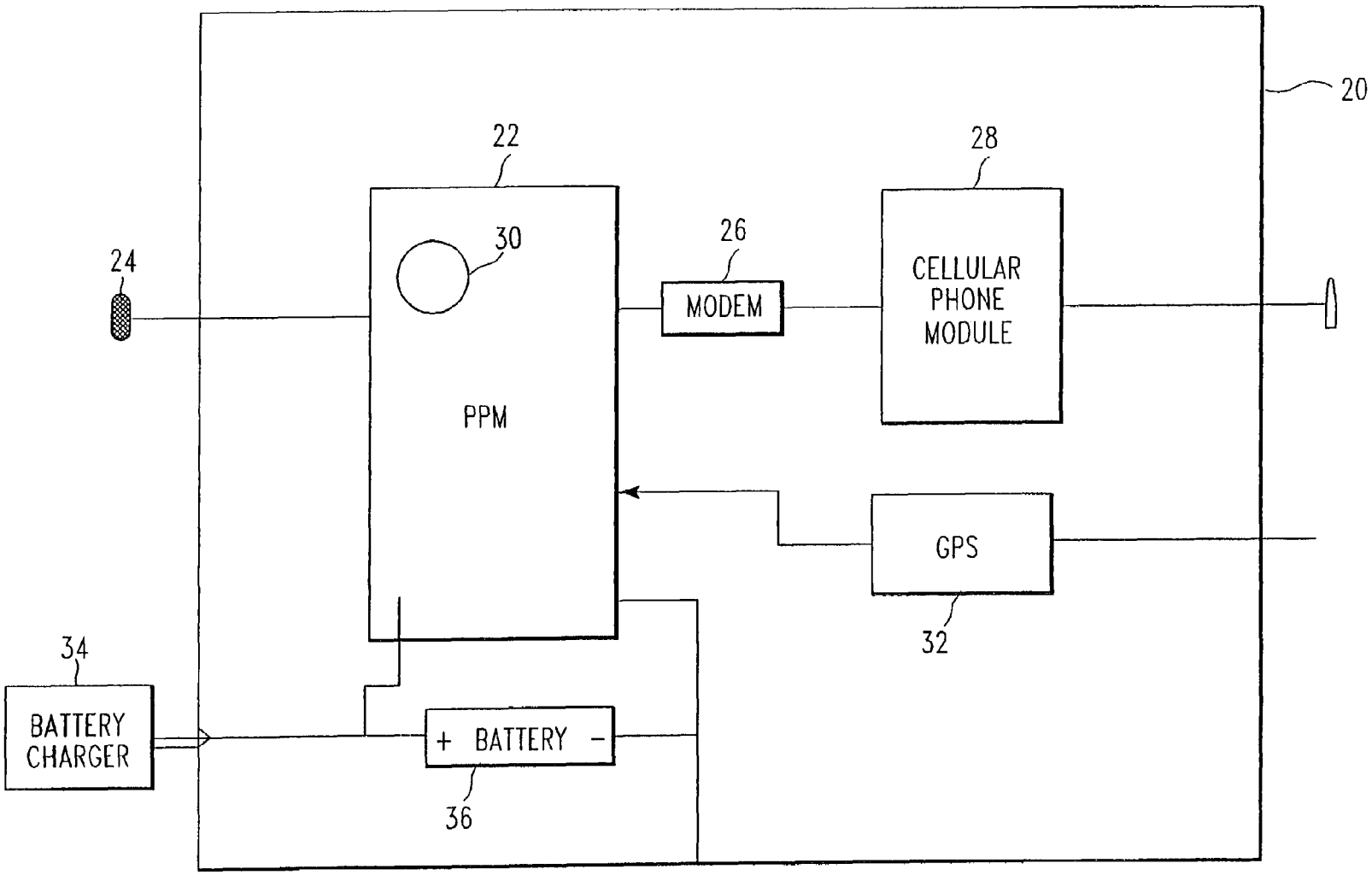
FIG. 2 is a block diagram of a combination Personal People Meter and cellular telephone which is used in the system of FIG. 1.

A typical combination PPM and cellular telephone device 20 is illustrated in FIG. 2. In this case, the PPM unit 22 is connected to a microphone 24 which converts sounds represented by the received audio signals into electronic signals. The PPM 22 includes a device, disclosed in the aforementioned patents, for detecting program identifying ("PI") information from the microphone output signal. The PPM 22 incorporates a programmed microprocessor as well as a nonvolatile memory (not shown) for storing the detected PI information. Finally, the device 20 includes a modem 26 and cellular telephone 28 for establishing a wireless communication link to the central computer via the public cellular telephone network.

As is standard, the PPM 22 includes a clock 30 to provide a date and time stamp to the PI information when it is received. If desired, the device 24 can also include a GPS receiver 32 which adds location information in association with the received PI information.

Finally, the device 20 is connectable to a battery charger 34 for periodically charging an internal battery 36.

The device 20 operates to either initiate telephone communication with the central computer 10 on a periodic basis and/or to receive periodic telephone calls from the central computer. Once a communication link is established, the Personal People Meter will transmit the data stored in its memory to the central computer 10. If desired, software updates or test messages may be transmitted from the central computer to the Personal People Meter.

Figure 3:
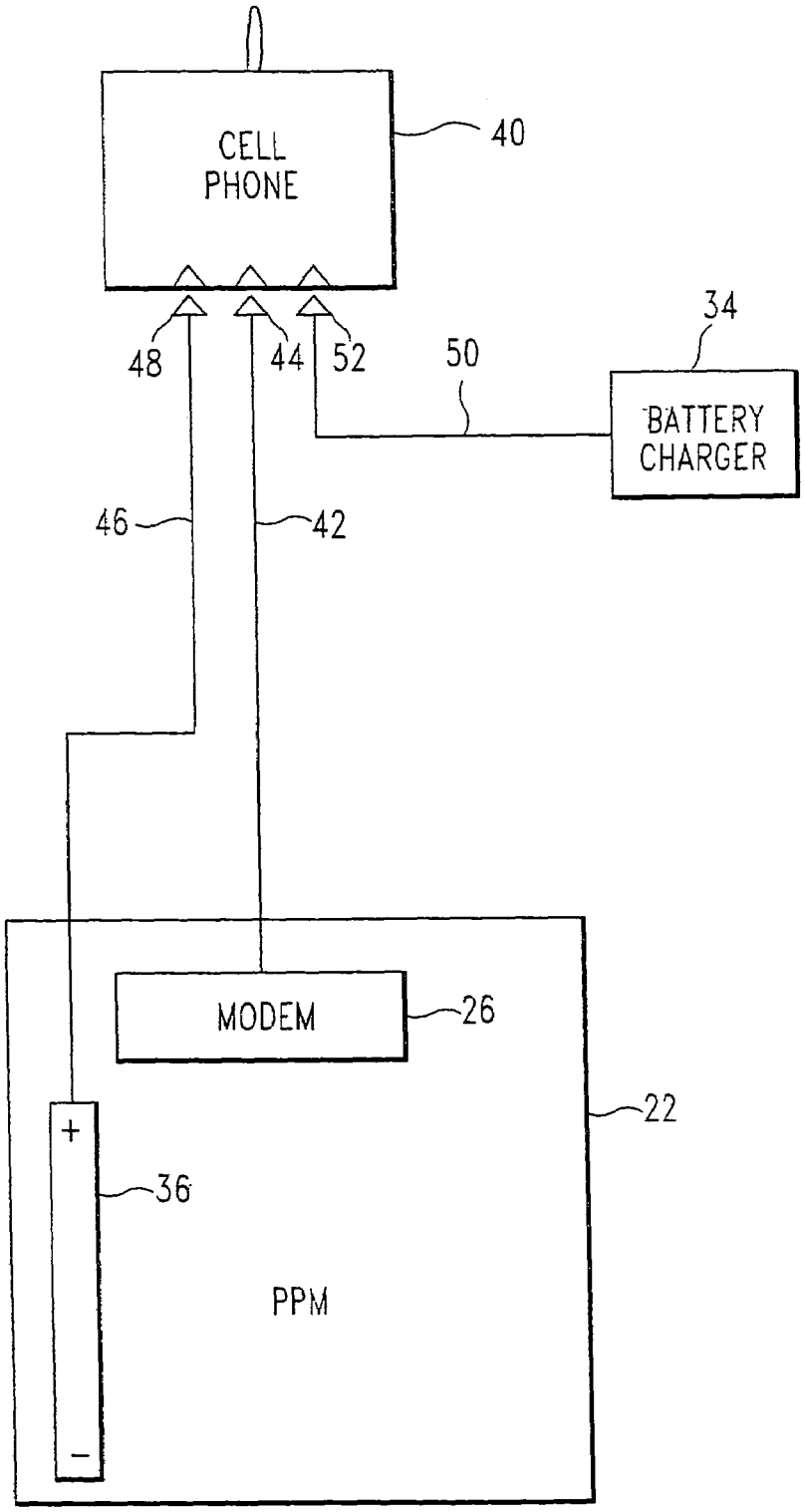
FIG. 3 is a block diagram of an alternative embodiment wherein a Personal People Meter communicates with a central computer via a separate cellular telephone.

FIG. 3 shows an alternative embodiment wherein the Personal People Meter 22, with its modem 26, are separated from a hand held cellular telephone 40 by a length of wire 42, connectable to the cellular telephone by a jack 44. With this embodiment, the cellular telephone may therefore be used independently of the Personal People Meter and connected only periodically, for example during nighttime, to transmit or receive calls for the exchange of data.

As shown in FIG. 3, a separate line 46 may be connected to the cellular telephone via a jack 48 to recharge the battery 36 of the Personal People Meter. In this case, the battery within the cellular telephone 40 as well as the battery 36 in the Personal People Meter are recharged from a battery charger 34 that is connectable to the telephone unit 40 by means of a wire 50 and jack 52.

There has thus been shown and described a novel method and apparatus for monitoring audio listening which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method for receiving, detecting, collecting and analyzing program material-identifying ("PMI") information contained in a plurality of broadcast or recorded electronic audio signals, each audio signal representing sounds in a plurality of sequential program segments, each item of PMI information corresponding to a particular program segment, said method comprising the steps of:

(a) receiving a selected one of said audio signals at each of a plurality of remote locations;

(b) reproducing the sounds represented by said selected audio signal at each remote location;

(c) converting the sounds into a second electronic signal at each remote location;

(d) detecting the PMI information from the second signal at each remote location;

(e) storing the detected PMI information at each remote location;

(f) storing the date and time of receipt of said selected audio signal in association with said PMI information;

(g) establishing a wireless communication link between each remote location and a central computer at another location and transmitting the PMI information and its associated date and time to said central computer;

(h) storing the PMI information and its associated date and time received from said plurality of remote locations at said central computer; and (i) analyzing the stored PMI information and its associated date and time;

wherein said PMI information comprises inaudible information embedded in said audio signals.

2. The method defined in claim 1, further comprising the step of downloading instructions to said remote locations via said communication link.

3. The method defined in claim 1, wherein said PMI information comprises a code.

4. The method defined in claim 1, wherein said communication link is established in a public cellular telephone network, and wherein said PHI information is transmitted via said cellular telephone network to said central computer.

5. The method defined in claim 1, wherein said communication link is established by said central computer calling each remote location at periodic intervals.

6. The method defined in claim 1, wherein said communication link is established by each remote location calling said central computer at periodic intervals.

7. The method defined in claim 1, wherein said PMI information is analyzed to obtain a statistical estimate of the relative number of persons who listened to the sounds in each given program segment.

8. The method defined in claim 1, further comprising the steps of reproducing the sounds represented by said selected audio signal at each remote location by means of a loudspeaker and converting the sounds into a second electronic signal at each remote location, by means of a microphone.

9. The method defined in claim 1, wherein said PMI information comprises inaudible information embedded in said audio signals.

10. A method for receiving, detecting, collecting and analyzing program material-identifying ("PMI") information contained in a plurality of broadcast or recorded electronic audio signals, each audio signal representing sounds in a plurality of sequential program segments, each item of PMI information corresponding to a particular program segment, said method comprising the steps of:

(a) receiving a selected one of said audio signals at each of a plurality of remote locations, wherein each remote location has an associated, location-identifying ("LI") information;

(b) reproducing the sounds represented by said selected audio signal at each remote location;

(c) converting the sounds into a second electronic signal at each remote location;

(d) detecting the PMI information from the second signal at each remote location;

(e) storing the detected PMI information at each remote location;

(f) storing the respective LI information at each remote location in association with said PMI information;

(g) establishing a wireless communication link between each remote location and a central computer at another location and transmitting the PMI information and the respective LI information for that remote location to said central computer;

(h) storing the PMI information and the respective LI information received from said plurality of remote locations at said central computer; and (i) analyzing the stored PMI information and LI information;

wherein said PMI information comprises inaudible information embedded in said audio signals.

11. The method defined in claim 10, wherein said PMI information comprises a code.

12. The method defined in claim 10, wherein said communication link is established in a public cellular telephone network, and wherein said PMI information is transmitted via said cellular telephone network to said central computer.

13. The method defined in claim 10, wherein said communication link is established by said central computer calling each remote location at periodic intervals.

14. The method defined in claim 10, wherein said communication link is established by each remote location calling said central computer at periodic intervals.

15. The method defined in claim 10, wherein said PMI information is analyzed to obtain a statistical estimate of the relative number of persons who listened to the sounds in each given program segment.

16. The method defined in claim 10, further comprising the steps of reproducing the sounds represented by said selected audio signal at each remote location by means of a loudspeaker and converting the sounds into a second electronic signal at each remote location, by means of a microphone.

17. The method defined in claim 10, wherein said PMI information comprises inaudible information embedded in said audio signals.

18. A method for receiving, detecting, collecting and analyzing program material-identifying ("PMI") information contained in a plurality of broadcast or recorded electronic audio signals, each audio signal representing sounds in a plurality of sequential program segments, each item of PHI information corresponding to a particular program segment, said method comprising the steps of:

(a) receiving a selected one of said audio signals at each of a plurality of remote locations;

(b) reproducing the sounds represented by said selected audio signal at each remote location;

(c) converting the sounds into a second electronic signal at each remote location;

(d) detecting the PMI information from the second signal at each remote location;

(e) storing the detected PMI information at each remote location;

(f) storing the place of receipt of said PMI information in association with said PMI information;

(g) establishing a wireless communication link between each remote location and a central computer at another location and transmitting the PMI information and its associated place of receipt to said central computer;

(h) storing the PMI information and its associated place of receipt, as received from said plurality of remote locations, at said central computer; and (i) analyzing the stored PMI information and associated place of receipt;

wherein said PMI information comprises inaudible information embedded in said audio signals.

19. The method defined in claim 18, wherein said step of storing the place of receipt comprises the step of determining said place of receipt by means of the global positioning system (GPS).

20. The method defined in claim 18, wherein said PMI information comprises a code.

21. The method defined in claim 18, wherein said communication link is established in a public cellular telephone network, and wherein said PMI information is transmitted via said cellular telephone network to said central computer.

22. The method defined in claim 18, wherein said communication link is established by said central computer calling each remote location at periodic intervals.

23. The method defined in claim 18, wherein said communication link is established by each remote location calling said central computer at periodic intervals.

24. The method defined in claim 18, wherein said PMI information is analyzed to obtain a statistical estimate of the relative number of persons who listened to the sounds in each given program segment.

25. The method defined in claim 18, further comprising the steps of reproducing the sounds represented by said selected audio signal at each remote location by means of a loudspeaker and converting the sounds into a second electronic signal at each remote location, by means of a microphone.

26. The method defined in claim 18, wherein said PMI information comprises inaudible information embedded in said audio signals.

27. A method for receiving, detecting, collecting and analyzing program material-identifying ("PMI") information contained in a plurality of broadcast or recorded electronic audio signals, each audio signal representing sounds in a plurality of sequential program segments, each item of PMI information corresponding to a particular program segment, said method comprising the steps of:

(a) receiving a selected one of said audio signals at each of a plurality of remote locations;

(b) reproducing the sounds represented by said selected audio signal at each remote location;

(c) converting the sounds into a second electronic signal at each remote location;

(d) detecting the PMI information from the second signal at each remote location;

(e) storing the detected PMI information at each remote location;

(g) establishing a wireless communication link between each remote location and a central computer at another location and transmitting the PMI information and its associated date and time to said central computer;

(h) determining the place of said remote location when establishing a communication link between said remote location and said central station, and transmitting said place to said central station together with said PMI information;

(i) storing the PMI information and the place information received from said plurality of remote locations at said central computer; and (j) analyzing the stored PMI information and the place information;

wherein said PMI information comprises inaudible information embedded in said audio signals.

28. The method defined in claim 27, wherein said communication link includes a public cellular telephone network having a plurality of wireless transmission towers, and wherein said place of said remote location is determined by identifying the nearby wireless transmission tower which is employed in the communication link.

29. The method defined in claim 27, wherein said PMI information comprises a code.

30. The method defined in claim 27, wherein said communication link is established in a public cellular telephone network, and wherein said PMI information is transmitted via said cellular telephone network to said central computer.

31. The method defined in claim 27, wherein said communication link is established by said central computer calling each remote location at periodic intervals.

32. The method defined in claim 27, wherein said communication link is established by each remote location calling said central computer at periodic intervals.

33. The method defined in claim 27, wherein said PMI information is analyzed to obtain a statistical estimate of the relative number of persons who listened to the sounds in each given program segment.

34. The method defined in claim 27, further comprising the steps of reproducing the sounds represented by said selected audio signal at each remote location by means of a loudspeaker and converting the sounds into a second electronic signal at each remote location, by means of a microphone.

35. The method defined in claim 27, wherein said PMI information comprises inaudible information embedded in said audio signals.

36. A method for receiving, detecting, collecting and analyzing program segments contained in a plurality of broadcast or recorded electronic audio signals, each audio signal representing sounds in a plurality of program segments arranged sequentially, said method comprising the steps of:

(a) receiving a selected one of said audio signals at each of a plurality of remote locations;

(b) reproducing the sounds represented by said selected audio signal at each remote location, by means of a loudspeaker;

(c) converting the sounds into a second electronic signal at each remote location, by means of a microphone;

(d) detecting the program segments from the second signal at each remote location;

(e) storing the identity of the detected program segments at each remote location;

(f) establishing a wireless communication link between each remote location and a central computer at another location and transmitting the program segment information to said central computer along with information as to the location, date and time at which said selected one of said audio signals was received;

(g) storing the program segment information received from said plurality of remote locations at said central computer; and (h) analyzing the stored program segment information.

37. The method defined in claim 36, wherein said PMI information comprises a code.

38. The method defined in claim 36, wherein said communication link is established in a public cellular telephone network, and wherein said PMI information is transmitted via said cellular telephone network to said central computer.

39. The method defined in claim 36, wherein said communication link is established by said central computer calling each remote location at periodic intervals.

40. The method defined in claim 36, wherein said communication link is established by each remote location calling said central computer at periodic intervals.

41. The method defined in claim 36, wherein said PMI information is analyzed to obtain a statistical estimate of the relative number of persons who listened to the sounds in each given program segment.

42. The method defined in claim 36, further comprising the steps of reproducing the sounds represented by said selected audio signal at each remote location by means of a loudspeaker and converting the sounds into a second electronic signal at each remote location, by means of a microphone.

43. The method defined in claim 36, wherein said PMI information comprises inaudible information embedded in said audio signals.

* * * * *